United States Patent [19]

Scott

[11] Patent Number: 4,930,998

[45] Date of Patent: Jun. 5, 1990

[54] FUEL PUMP

[75] Inventor: Robert H. Scott, Chatham, England

[73] Assignee: Lucas Industries Public Limited Company, Birmingham, England

[21] Appl. No.: 222,948

[22] Filed: Jul. 22, 1988

[30] Foreign Application Priority Data

Jul. 22, 1987 [GB] United Kingdom ..... 8717326

[51] Int. Cl.[5] ..... F04B 19/22

[52] U.S. Cl. ..... 417/462; 123/450

[58] Field of Search ..... 417/462; 123/450

[56] References Cited

U.S. PATENT DOCUMENTS 4,358,256 11/1982 Jefferson ..... 417/462
4,362,140 12/1982 Jefferson et al. ..... 417/462
4,422,425 12/1983 Jefferson ..... 417/462

FOREIGN PATENT DOCUMENTS 647288 10/1962 Italy ..... 417/462

*Primary Examiner*—Leonard E. Smith

*Assistant Examiner*—Robert N. Blackmon

*Attorney, Agent, or Firm*—Balogh, Osann, Kramer, Dvorak, Genova & Traub

[57] ABSTRACT

A rotary distributor type fuel injection pump has a pair of angularly adjustable stop rings having shaped internal surfaces which can engage with the cam followers of the pump to limit the outward movement of the pump plungers. The stop rings are interconnected by a saddle member and a spring biases the saddle member into engagement with a stop. The stop which may be adjustable determines the normal maximum amount of fuel which can be supplied by the pump. For starting purposes the stop rings are moved to an excess fuel position which is achieved by a pin engaged in a slot in one of the rings. The pin is spring biased to move the one end and hence the other ring to an excess fuel position and is coupled to a fluid pressure operable piston which when the associated engine is started is moved by fluid pressure to move the pin to allow the spring to move the saddle member and stop into engagement with the stop.

3 Claims, 3 Drawing Sheets

FUEL PUMP

This invention relates to a rotary distributor type fuel injection pump for supplying fuel to an internal combustion engine and of the kind comprising a body part, a rotary distributor member supported in the body part and arranged in use to be driven in timed relationship with the associated engine, a transverse bore formed in the distributor member, a pumping plunger slidable in the bore, a cam follower at the outer end of the plunger, an annular cam ring surrounding the distributor member and having cam lobes on its internal peripheral surface for engagement by the cam follower, said cam lobes imparting inward movements to the plunger as the distributor member rotates, passage means for conveying fuel displaced from the bore to a plurality of outlets in turn, further passage means for feeding fuel to the bore to effect outward movements of the plunger, a fuel control device operable to allow the volume of fuel supplied to the bore to be varied, a pair of annular angularly adjustable stop rings positioned in the body part on opposite sides of the cam ring respectively, said stop rings defining internal surfaces for engagement by the cam follower to limit the outward movement of the plunger and thereby to limit the maximum amount of fuel which can be supplied by the pump, a saddle member movable in the body part, the saddle member and the stop rings defining interengaged coupling elements respectively whereby the angular setting of the stop rings can be adjusted by moving the saddle member, resilient means acting to move the stop rings in a direction to reduce the amount of fuel which can be supplied by the pump and a stop for limiting the movement of the stop rings under the action of said resilient means.

For engine starting purposes the stop rings are moved to a position in which an excess of fuel is supplied by the pump and for this purpose a further resilient means is provided which is stronger than the first resilient means and which acts to move the stop rings to said position. Once the engine has started the rings are moved from said position and this is achieved using a fluid pressure responsive piston which acts to reduce the force exerted by the further resilient means and this allows the stop rings to move under the action of the first mentioned resilient means. It has been the practice to locate the piston in a cylinder close to the saddle. However, in some pumps it is necessary to provide for adjustment of said stop in accordance with an engine operating parameter such for example as the engine air inlet manifold pressure. For this purpose the aforesaid stop is adjustable by means of a pressure responsive device such as a diaphragm, which is contained within a housing secured to the body part of the pump. It is not always easy to accommodate the device and the aforesaid piston in close proximity to the saddle and the object of the present invention is to provide a pump of the kind specified in a simple and convenient form.

According to the invention a pump of the kind specified comprises a fluid pressure operable piston located within a cylinder formed in the body part, a pin extending laterally from said piston and located in an elongated recess formed in one of said stop rings, said piston being biased by further resilient means in the direction to urge the pin into engagement with one end wall of the recess thereby to move the stop rings to a position in which an excess of fuel can be supplied by the pump, the piston being moved by fluid under pressure against the action of the resilient means to allow the stop rings to be moved to reduce the maximum amount of fuel which can be supplied by the pump.

An example of a pump in accordance with the invention will now be described with reference to the accompanying drawings in which.

Figure 1:
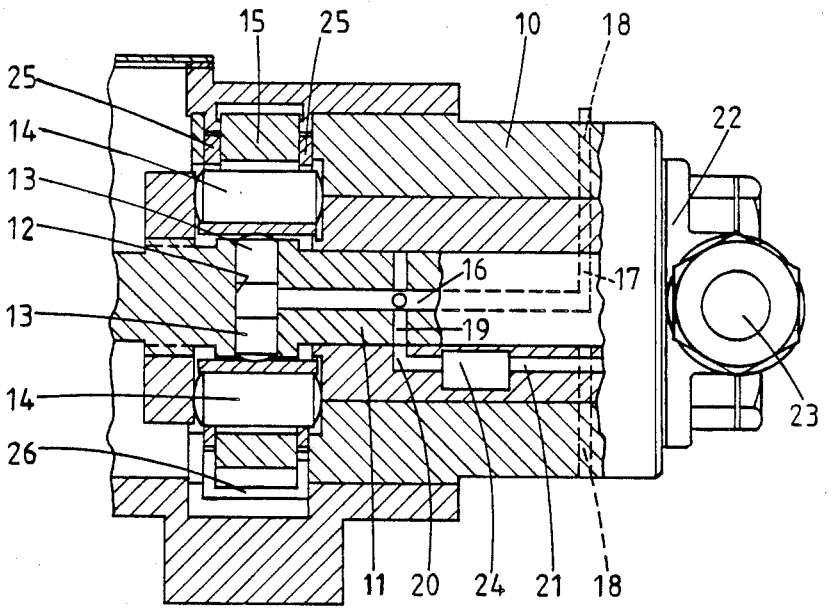
FIG. 1 is a diagrammatic sectional side elevation of the pump.

Referring to FIG. 1 of the drawings the pump comprises a body part 10 in which is journalled a rotary cylindrical distributor member 11 in which is formed a transversely extending bore 12. The distributor member in use is driven in timed relationship with an associated engine, the distributor member for this purpose being coupled to a drive shaft not shown.

Located in the bore is a pair of pumping plungers 13 at the outer ends of which are located cam followers each of which includes a roller 14. The rollers are engaged by cam lobes formed on the internal peripheral surface of an annular cam ring 15 which is located within the body part and which for the purpose of timing adjustment, may be angularly adjustable within the body part.

The portion of the bore lying intermediate the plungers 13, communicates with a passage 16 extending longitudinally within the distributor member and at one point the passage 16 communicates with a delivery passage 17 which is positioned to register in turn with a plurality of outlet ports 18 formed in the body part, the outlets in use being connected to the injection nozzles of the associated engine respectively.

At another point the longitudinal passage 16 communicates with a plurality of inlet passage 19 which are positioned to register in turn with an inlet port 20 formed in the body part and connected to the outlet 21 of a low pressure fuel supply pump 22 which has an inlet 23. the communication of the inlet port 20 with an inlet passage 19 occurs during the time when the plungers are allowed to move outwardly by the cam lobes and the quantity of fuel which is supplied to the bore during this period is controlled by a control device 24 which may form example be an adjustable throttle. As the distributor member continues to rotate the inlet passage 19 moves out of register with the inlet port 20 and the delivery passage 17 moves into register with an outlet 18 to allow fuel displaced during the inward movement of the plungers to flow to the appropriate outlet.

In order to control the maximum amount of fuel which can be supplied by the pump to the associated engine, a pair of stop rings 25 are provided, these being positioned on the opposite sides of the cam ring 15 and being mounted for angular adjustment within the body part. The internal surfaces of the stop rings are shaped to define stop surfaces for engagement by the rollers during the outward movement of the plungers. The extend of outward movement of the plungers and therefore the maximum amount of fuel which can be supplied to the associated engine is determined by the angular setting of the stop rings.

Figure 2:
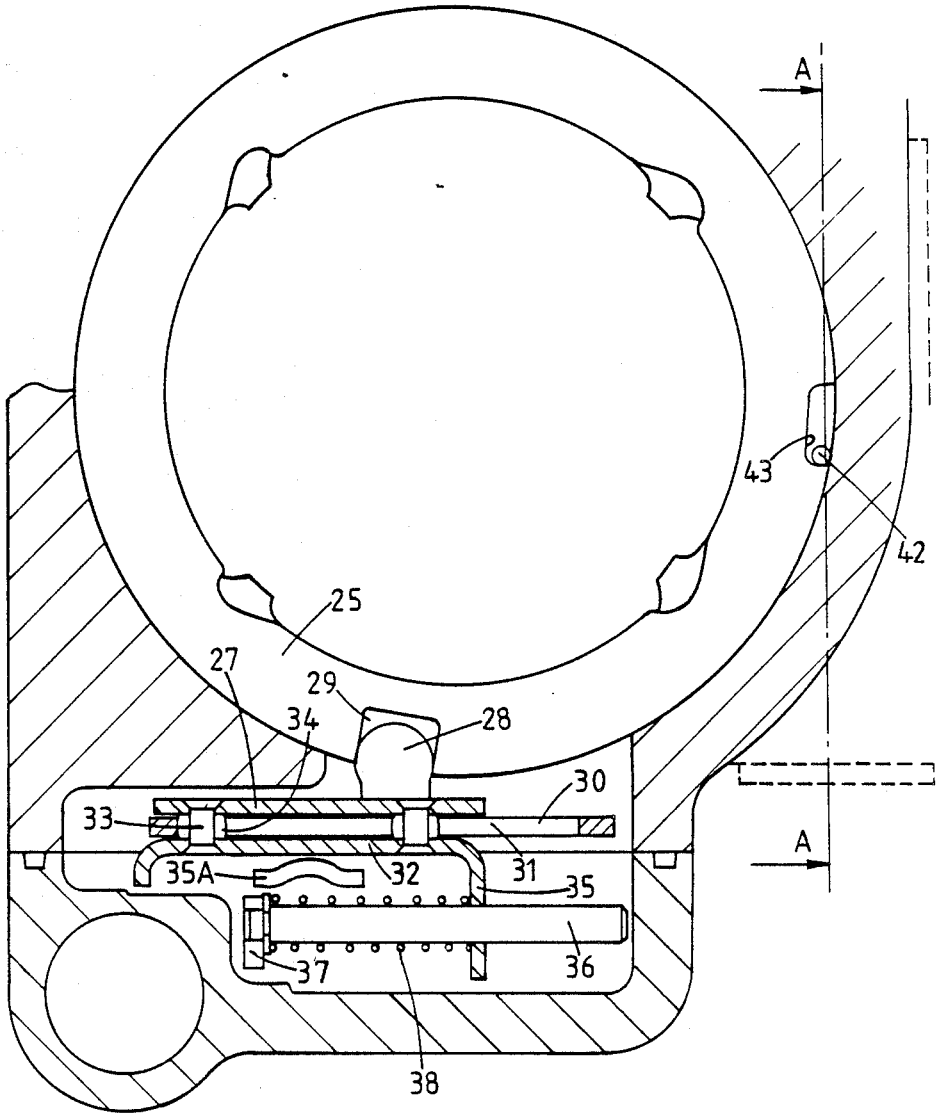
FIG. 2 is a section to an enlarged scale of part of the pump shown in FIG. 1.

The stop rings are connected together so that they move angularly in unison, by means of a saddle member 26 which, as shown in FIG. 2, includes a base section 27 upstanding from which are a pair of spaced tongues 28 which engage within slots 29 respectively formed in the stop plates 25. The saddle member is located on one side of a support plate 30 which is secured within the body part and which is provided with a slot 31. On the opposite side of the support plate 30 is a generally U-shaped member 32, the U-shaped member and the base section of the saddle member being secured together by rivets 33, there being located about each rivet, spacers 34 which slide in the slot 31.

One limb 35 of the U-shaped member is provided with an aperture through which extends a spring locating rod 36 the rod being carried on a support 37 secured within the body part. Interposed between the support 37 and the limb is a spring 38 the effect of which is to bias the saddle member and therefore the stop plates, towards a position to reduce the maximum amount of fuel which can be supplied to the associated engine. A stop 35A is provided to determine the movement of the saddle member under the action of the spring 38 and the stop 35A can form part of a device responsive to an engine operating parameter such for example as the pressure within the air inlet manifold of the engine.

Figure 3:
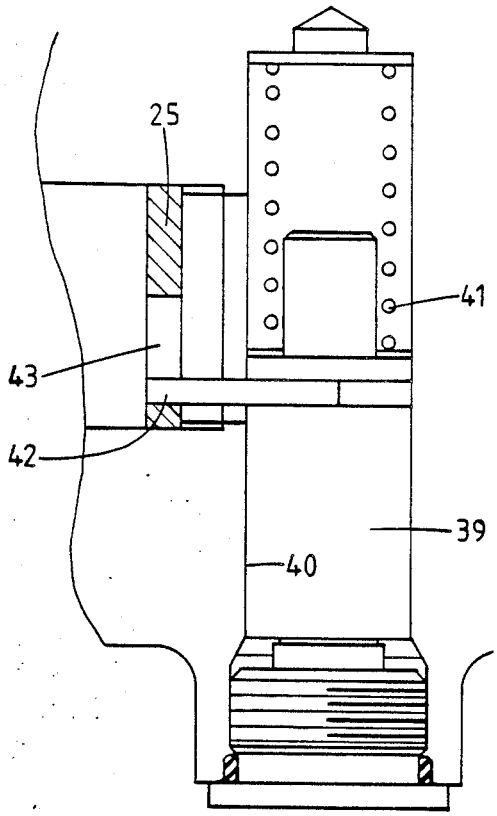
FIG. 3 is a section on the line A—A of FIG. 2.

For the purpose of starting the associated engine an excess of fuel must be supplied, the excess quantity being greater than the normal maximum quantity of fuel. In order to move the stop rings to permit an excess of fuel to be supplied, a spring loaded piston as shown in FIG. 3 is provided, the piston 39 being located within a cylinder 40 formed in the body part and the piston being biased against the action of fluid under pressure, by means of a spring 41. The piston carries a tranversely extending pin 42 which locates within a groove 43 formed in one of the stop plates 25. The pin is engageable and is so engaged in the drawings, with an end wall of the groove 43 and the strength of spring 41 is such that when the pump is at rest, the pin engages the end wall of the groove and moves the stop ring angularly to a position in which an excess of fuel is supplied to the associated engine. Movement of the one stop ring means that the other stop ring is also moved due to the action of the saddle member, and it will be appreciated that the force exerted by the spring 41 overcomes the force exerted by the spring 38.

The end of the cylinder 40 remote from the spring 41 is connected to the outlet 21 of the low pressure pump 22 and the effect therefore is that when the associated engine is at rest the stop rings are moved to the position shown in the drawings in which an excess of fuel will be supplied to the associated engine for starting purposes. As soon as the engine starts the pump 22 will deliver fuel under pressure to the cylinder 40 and the piston 39 will start to move against the action of the spring 41. Such movement will allow the stop rings under the influence of the spring 38 to move to reduce the amount of fuel which can be supplied to the engine, the final position of the stop rings being determined by the aforementioned stop. The position of the pin 42 relative to the groove 43 is such that the stop rings can be moved by the aforesaid stop 35A if the latter is of the type responsive to an engine operating parameter.

By placing the piston 39 and the associated spring 41 away from the saddle member, more space is available to accommodate the aforesaid stop. Moreover, the stop itself acts on the saddle member which therefore provides more precise control of the two stop plates whereas the pin acts on one stop plate only so that the position of the other stop plate depends upon the tolerances and clearances in the connection between the stop plates. This however is less important when the pump is set to deliver excess of fuel to the associated engine.

I claim:

1. A fuel injection pump of the rotary distributor type for supplying fuel to an internal combustion engine and of the kind comprising a body part, a rotary distributor member supported in the body part and arranged in use to be driven in timed relationship with the associated engine, a transverse bore formed in the distributor member, a pumping plunger slidable in the bore, a cam follower at the outer end of the plunger, an annular cam ring surrounding the distributor member and having cam lobes on its internal peripheral surface for engagement by the cam follower, said cam lobes imparting inward movements to the plunger as the distributor member rotates, passage means for conveying fuel displaced from the bore to a plurality of outlets in turn, further passage means for feeding fuel to the bore to effect outward movements of the plunger, a fuel control device operable to allow the volume of fuel supplied to the bore to be varied, a pair of annular angularly adjustable stop rings positioned in the body part on opposite sides of the cam ring respectively, said stop ring defining internal surfaces for engagement by the cam follower to limit the outward movement of the plunger and thereby to limit the maximum amount of fuel which can be supplied by the pump, a saddle member movable in the body part, the saddle member and the stop rings defining interengaged coupling elements respectively whereby the angular setting of the stop rings can be adjusted by moving the saddle member, resilient means acting to move the stop rings in a direction to reduce the amount of fuel which can be supplied by the pump and a stop for limiting the movement of the stop rings under the action of said resilient means, characterised by a fluid pressure operable piston located within a cylinder formed in the body part, a pin extending laterally from said piston and located in an elongated recess formed in one of the stop rings, further resilient means biasing said piston in the direction to urge the pin into engagement with one end wall of the recess thereby to move the stop rings to a position in which an excess of fuel can be supplied by the injection pump, the piston being moved by fluid under pressure against the action of the further resilient means to allow the stop rings to be moved to reduce the maximum amount of fuel which can be supplied by the injection pump.

2. An injection pump according to claim 1 characterised in that said stop is positioned to be engaged by said saddle member.

3. An injection pump according to claim 2 characterised in that said is adjustable and that the length of said slot is such that in the engine run condition the pin lies intermediate the ends of the slot.

* * * * *